US009705268B1

(12) United States Patent
Yuan

(10) Patent No.: US 9,705,268 B1
(45) Date of Patent: Jul. 11, 2017

(54) CONNECTOR WITH CONFIGURATION PIN BETWEEN GROUND PIN AND POWER PIN

(71) Applicant: SIMULA TECHNOLOGY INC., Taoyuan (TW)

(72) Inventor: Lun-Yong Yuan, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 15/271,285

(22) Filed: Sep. 21, 2016

(30) Foreign Application Priority Data

Jun. 14, 2016 (TW) ..... 105208815 U

(51) Int. Cl.
*H01R 13/66* (2006.01)
*H01R 24/60* (2011.01)
*H01R 107/00* (2006.01)

(52) U.S. Cl.
CPC ..... *H01R 24/60* (2013.01); *H01R 13/6616* (2013.01); *H01R 2107/00* (2013.01)

(58) Field of Classification Search
CPC . H01R 13/66; H01R 13/6616; H01R 13/6666
USPC ..... 439/620.01, 620.04, 660
See application file for complete search history.

(56) References Cited

U.S. PATENT DOCUMENTS

2015/0318646 A1* 11/2015 Little ..... H01R 4/023 439/78

* cited by examiner

*Primary Examiner* — Abdullah Riyami
*Assistant Examiner* — Thang Nguyen
(74) *Attorney, Agent, or Firm* — Bacon & Thomas, PLLC

(57) ABSTRACT

The present invention is to provide a connector having a configuration pin, configured to connect with a USB Type-C transmission port and including at least a ground terminal, at least a power terminal, at least a configuration channel and two signal transmission terminals, wherein each of the terminals and channels extends through an insulating base and has an inserting portion at the front end of the insulating base and a connecting portion at the rear end of the insulating base, and the connecting portion of the configuration channel lies between the connecting portion of the power terminal and the connecting portion of the ground terminal, thereby forming the configuration pin between a ground pin and a power pin of the connector. Thus, a resistor can be easily connected between the configuration pin and the ground pin or the power pin according to practical needs, without the risk of short-circuiting.

18 Claims, 5 Drawing Sheets

CONNECTOR WITH CONFIGURATION PIN BETWEEN GROUND PIN AND POWER PIN

FIELD OF THE INVENTION

The present invention relates to a connector, more particularly to a connector having a configuration pin and configured to connect with a USB Type-C transmission port, which includes at least a ground terminal, at least a power terminal, at least a configuration channel and two signal transmission terminals, wherein each of the terminals and channels extends through an insulating base and has an inserting portion at the front end of the insulating base and a connecting portion at the rear end of the insulating base, and the connecting portion of the configuration channel lies between the connecting portion of the power terminal and the connecting portion of the ground terminal, thereby forming the configuration pin between a ground pin and a power pin of the connector. Thus, a resistor can be easily connected between the configuration pin and the ground pin or the power pin according to practical needs, without the risk of short-circuiting.

BACKGROUND OF THE INVENTION

Universal Serial Bus (USB) Type-C connectors complying with the USB 3.1 standard were developed soon after the standard was published in 2014. Unlike the conventional USB connectors, which must be used in the "correct" orientation and therefore often inconvenience the users by having to be inserted for a second time, USB Type-C connectors feature a "lack of directionality", meaning they can be inserted with either side up and thus provide enhanced convenience of use. Another major feature of USB Type-C connectors is "slimness", with a size of about 3×2.5 mm, which makes such connectors more suitable for use in the increasingly downsized computation devices than are their bulkier counterparts.

USB Type-C connectors, however, are not the only connectors in compliance with the USB 3.1 standard. As with the USB 2.0 standard, connectors conforming to the USB 3.1 standard also include USB Type-A connectors and Micro-B connectors. USB Type-A connectors are the standard USB interface and are generally used in personal computers. Micro-B connectors, on the other hand, are a USB interface designed for mobile devices and are typically used in smartphones (e.g., mobile phones operating on an Android operating system). In other words, USB Type-C, as well as USB Type-A and Micro-B, connectors allow consumers to enjoy high-speed data transmission enabled by the USB 3.1 standard.

As stated above, different types of electronic devices use connectors of different specifications. Therefore, when it is desired to connect electronic devices whose connectors are unalike, e.g., to connect a Nokia N1 tablet computer, which is mounted with a USB Type-C connector, to a personal computer with a USB Type-A connector, it is common practice to make the connection via an additional transmission cable that allows the tablet computer and the personal computer to transmit data to each other. As another example, an Apple MacBook laptop computer, which has a USB Type-C connector, and a smartphone with a Micro-B connector can be connected by a transmission cable so that data transmission between the laptop and the smartphone can be carried out.

Generally, the foregoing transmission cables have a USB Type-C connecter at one end and a USB Type-A or Micro-B connector at the other end, depending on production requirements. In order for an electronic device to identify the type of a transmission cable, i.e., a "USB Type-C to USB Type-A" transmission cable, which adapts a USB Type-C connector to a USB Type-A connector, or a "USB Type-C to Micro-B" transmission cable, which adapts a USB Type-C connector to a Micro-B connector, the USB 3.1 standard provides that each USB Type-C connector have a configuration channel (CC); that when a transmission cable has a USB Type-C connector and a USB Type-A connector at its two ends respectively, a resistor be connected between the configuration channel and a power terminal (Vbus) of the USB Type-C connector; and that when a transmission cable has a USB Type-C connector and a Micro-B connector at its two ends respectively, a resistor be connected between the configuration channel and a ground terminal (GND) of the USB Type-C connector. To meet this requirement, the pin of a configuration channel (CC) is typically designed to be adjacent to the pin of either a power terminal (Vbus), as shown in FIG. 1A, or a ground terminal (GND), as shown in FIG. 1B. That is to say, once a USB Type-C connector is produced, the type of connector to which it can adapt, i.e., the type of connector that can be used in the same transmission cable as itself, is fixed. For example, a USB Type-C connector designed to adapt to a USB Type-A connector cannot be used to adapt to a Micro-B connector. The above limitation causes trouble to connector and transmission cable manufacturers in terms of production and stock control.

According to the above, the structure of the USB Type-C connector on a transmission cable needs improvement, and in the light of this, the issue to be addressed by the present invention is to design a novel connector structure that meets the adaptation and transmission requirements of USB Type-C connectors.

BRIEF SUMMARY OF THE INVENTION

The inventor of the present invention incorporated years of practical experience into repeated trials and tests and finally succeeded in developing a connector with a configuration pin between a ground pin and a power pin so as to overcome the aforementioned problems of the prior art.

One objective of the present invention is to provide a connector having a configuration pin between a ground pin and a power pin, wherein the connector is configured to connect with a USB Type-C transmission port and includes an insulating base, a first ground terminal (GND), a first power terminal (Vbus), at least one configuration channel (CC), a first signal transmission terminal, a second signal transmission terminal, and a housing. The first ground terminal extends through the insulating base, has an inserting portion at an outermost lateral position of the front end of the insulating base, and further has a connecting portion at the rear end of the insulating base and forming the ground pin. The first power terminal extends through the insulating base, has an inserting portion at the front end of the insulating base and adjacent to the inserting portion of the first ground terminal, and further has a connecting portion at the rear end of the insulating base and forming the power pin. The configuration channel extends through the insulating base, has an inserting portion at the front end of the insulating base and adjacent to the inserting portion of the first power terminal, and further has a connecting portion at the rear end of the insulating base and extending laterally from the inserting portion of the configuration channel so as to lie between the connecting portion of the first power terminal and the connecting portion of the first ground terminal, thereby forming the configuration pin. The signal transmission terminals extend through the insulating base and each have an inserting portion and a connecting portion. The inserting portions of the signal transmission terminals are adjacent to each other. The inserting portion of the first signal transmission terminal is adjacent to the inserting portion of the configuration channel. The connecting portions of the signal transmission terminals are at the rear end of the insulating base. The housing is mounted on a front section of the insulating base such that the inserting portions of all the terminals and of the configuration channel extend into the housing. Now that the configuration pin is between the ground pin and the power pin, a resistor can be easily connected between the configuration pin and the ground pin or between the configuration pin and the power pin according to practical needs, without the risk of short-circuiting. The connector, therefore, can be used and produced with great ease.

Another objective of the present invention is to provide the foregoing connector, wherein the connecting portion of each terminal and of the configuration channel is provided with an auxiliary plate that extends, and is bent, from the top side or bottom side of the connecting portion and that is perpendicular to the connecting portion to effectively increase the soldering area of the corresponding pin of the connector. The auxiliary plates facilitate the soldering of corresponding circuits and thereby contribute to a high yield of the connector.

BRIEF DESCRIPTION OF THE SEVERAL VIEWS OF THE DRAWINGS

The above and other objectives, as well as the technical features and effects, of the present invention are described in more detail below with reference to some illustrative embodiments and the accompanying drawings, in which.

DETAILED DESCRIPTION OF THE INVENTION

The present invention provides a connector that has a configuration pin between a ground pin and a power pin and that is applicable to a transmission cable and configured to connect with a transmission port complying with the Universal Serial Bus (USB) Type-C specification. In one embodiment, referring to FIG. 2, the connector 1 includes an insulating base 11, a first ground terminal (GND) G1, a second ground terminal G2, a first power terminal (Vbus) V1, a second power terminal V2, at least one configuration channel (CC) C1, a first signal transmission terminal D1, a second signal transmission terminal D2, and a housing 13. It should be pointed out that the entire structure of the connector 1 in this embodiment can be inserted into a transmission port supporting the USB 3.1 standard, and that the connector 1 can transmit data or power to a transmission port supporting the USB 2.0 standard. With the update of the USB standards, however, a person skilled in the art who has fully understood the overall technical features of the present invention may adjust the number of the terminals/configuration channel in the connector 1 as needed. All such modifications fall within the scope of the present invention provided that the modified version includes the first ground terminal G1, the first power terminal V1, and the configuration channel C1 of the connector 1 disclosed herein.

Figure 1A:
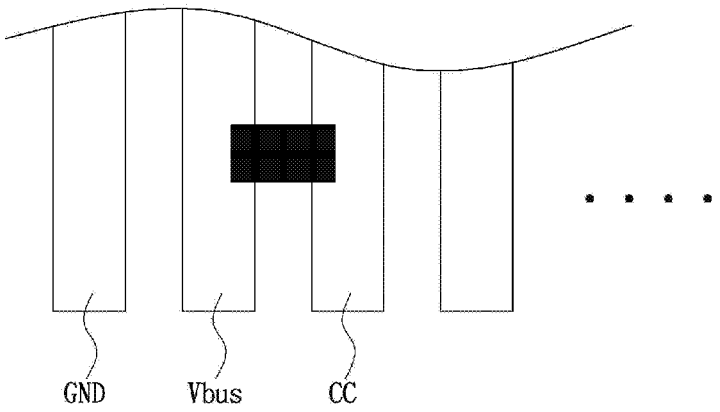
FIG. 1A(Prior Art)
FIG. 1A schematically shows the pins of a conventional connector.
Figure 1B:
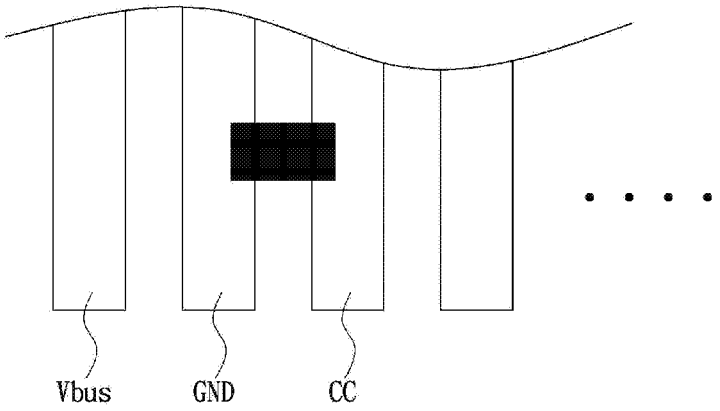
FIG. 1B(Prior Art)
FIG. 1B schematically shows the pins of another conventional connector.
Figure 2:
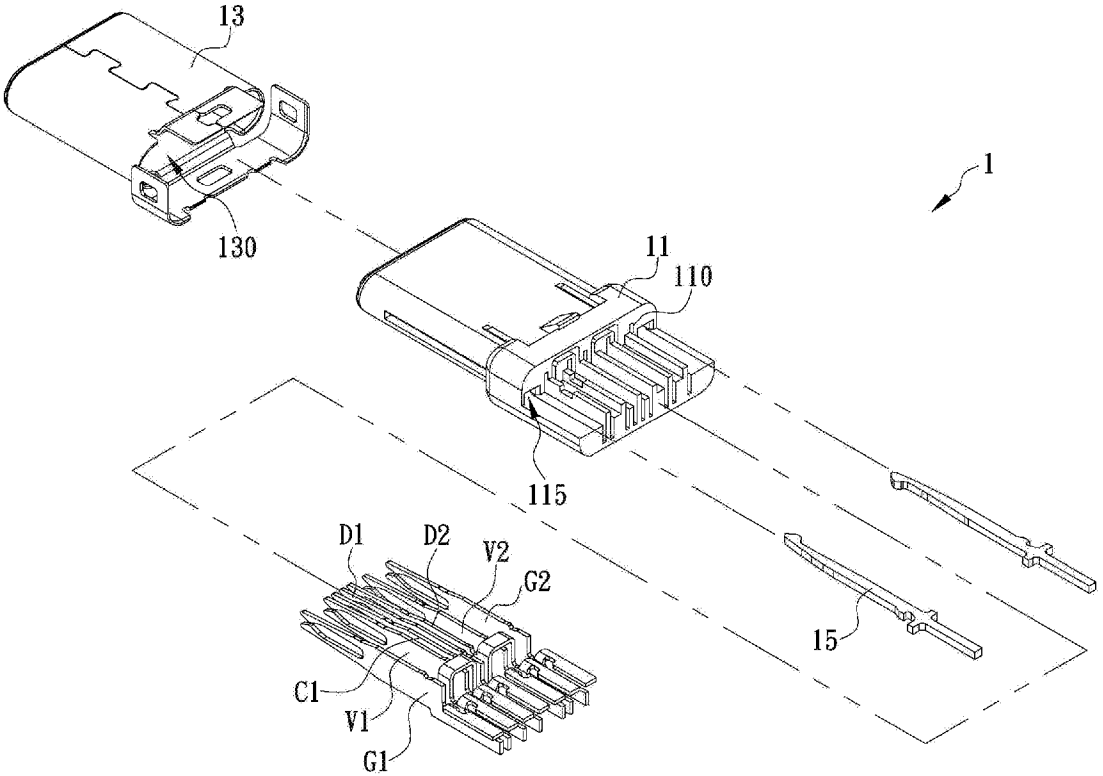
FIG. 2 is an exploded perspective view of the connector in an embodiment of the present invention.
Figure 3:
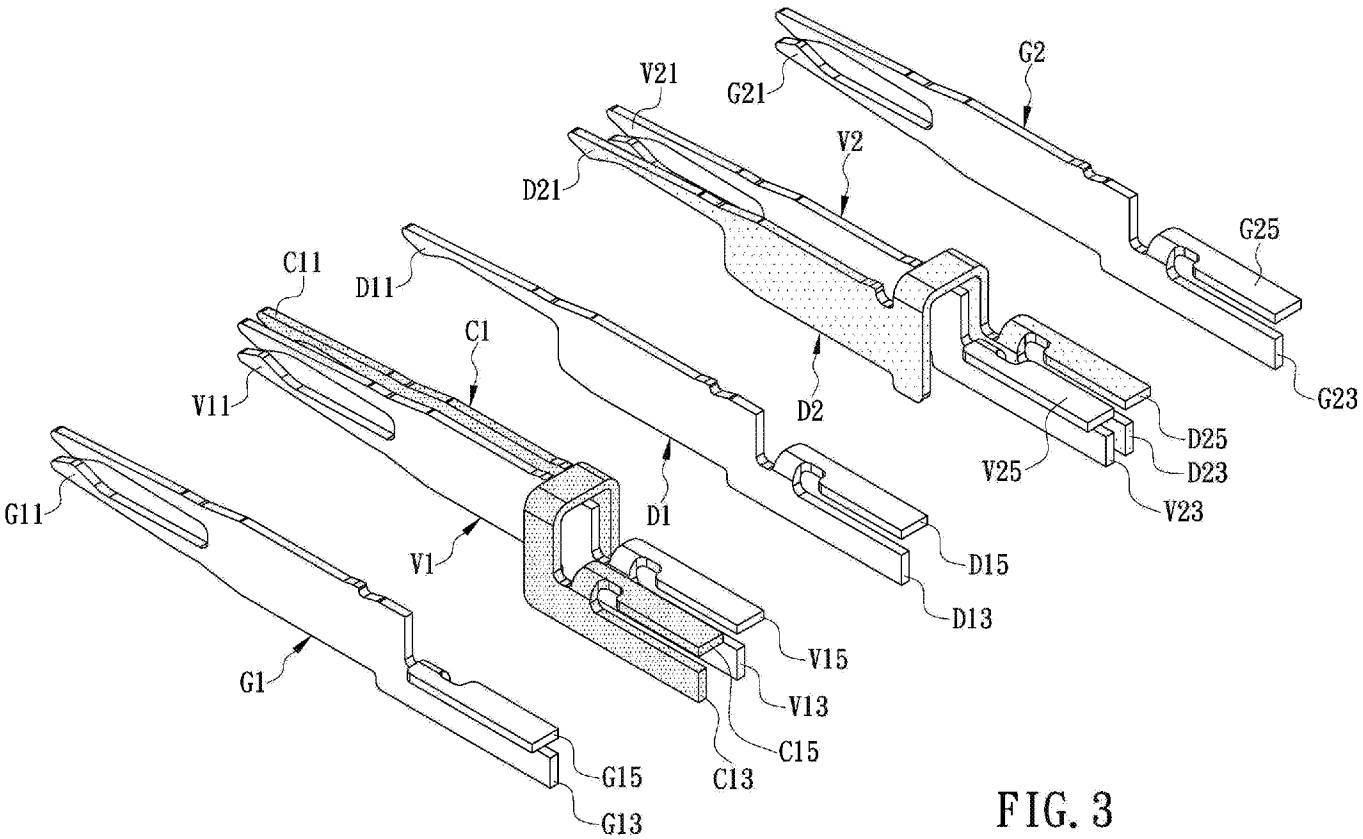
FIG. 3 is a perspective view of the terminals and the configuration channel of the connector in FIG. 2.

To facilitate description, referring to FIG. 2 and FIG. 3, the front side of each of the aforesaid elements is defined as the side facing the upper left corner of FIG. 2, the rear side as the side facing the lower right corner of FIG. 2, the left side as the side facing the lower left corner of FIG. 2, and the right side as the side facing the upper right corner of FIG. 2. The insulating base 11 is formed with a plurality of through holes 110, each opening at both the front and rear ends of the insulating base 11. The first ground terminal G1 and the second ground terminal G2 extend through the corresponding through holes 110 in the insulating base 11 respectively. The inserting portions G11, G21 of the ground terminals G1, G2 are located at the outermost lateral positions of the front end of the insulating base 11 respectively. In this embodiment, for example, the inserting portion G11 of the first ground terminal G1 is at the leftmost position, and the inserting portion G21 of the second ground terminal G2 is at the rightmost position. The connecting portions G13, G23 of the ground terminals G1, G2 are located at the rear end of the insulating base 11 and each form a ground pin.

As shown in FIG. 2 and FIG. 3, the first power terminal V1 and the second power terminal V2 extend through the corresponding through holes 110 in the insulating base 11 respectively. The inserting portions V11, V21 of the power terminals V1, V2 are located at the front end of the insulating base 11 and are adjacent to the inserting portions G11, G21 of the corresponding ground terminals G1, G2 respectively. In this embodiment, for example, the inserting portion V11 of the first power terminal V1 is adjacent to the inserting portion G11 of the first ground terminal G1 while the inserting portion V21 of the second power terminal V2 is adjacent to the inserting portion G21 of the second ground terminal G2. The connecting portions V13, V23 of the power terminals V1, V2 are located at the rear end of the insulating base 11 and each form a power pin.

Figure 4:
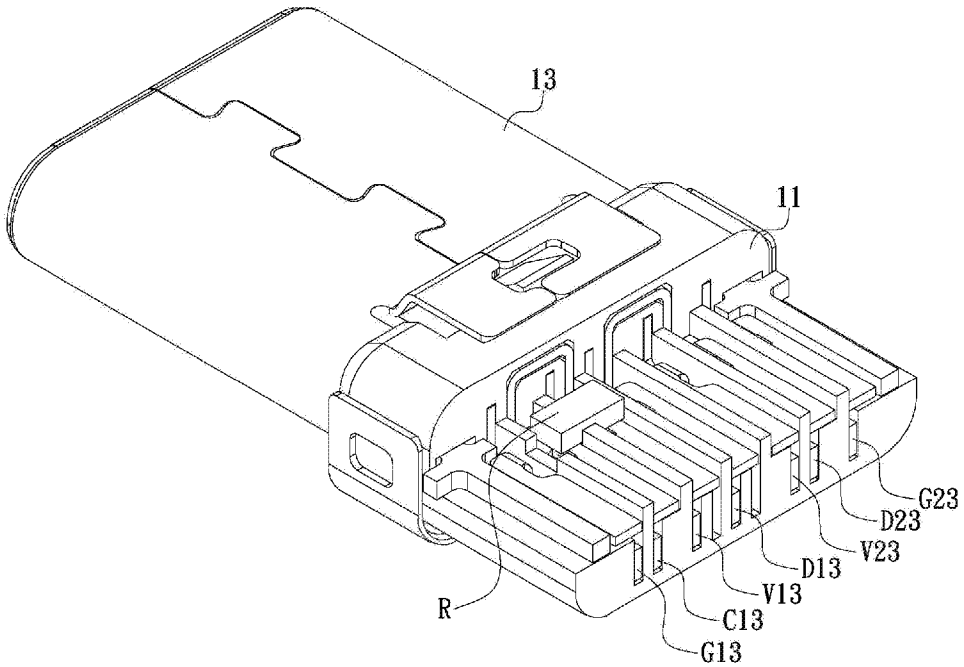
FIG. 4 shows the connector in FIG. 2 in a first application mode.
Figure 5:
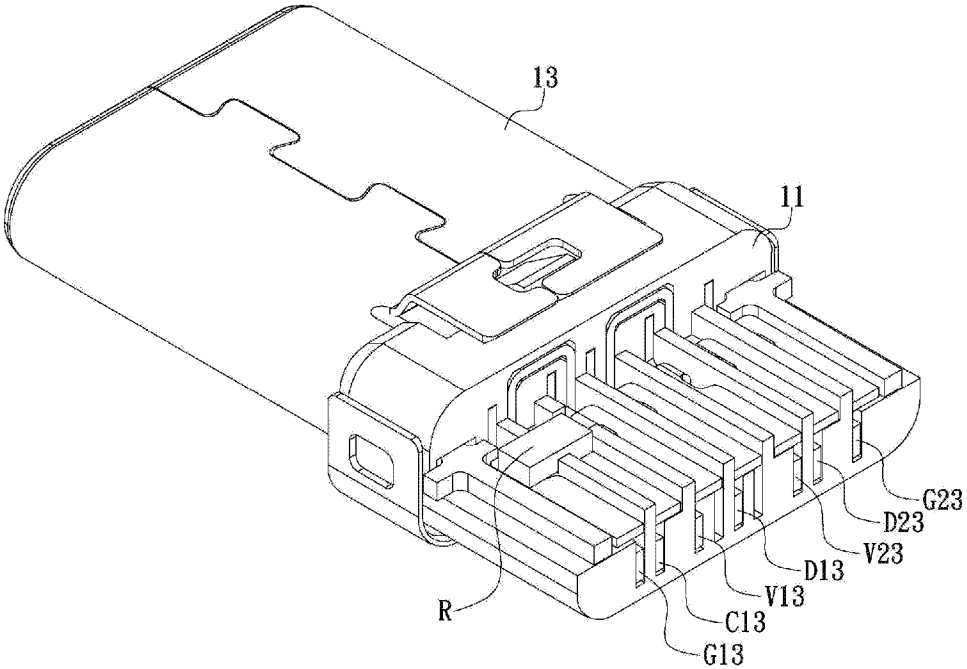
FIG. 5 shows the connector in FIG. 2 in a second application mode.

With continued reference to FIG. 2 and FIG. 3, the configuration channel C1 extends through the corresponding through hole 110 in the insulating base 11. The inserting portion C11 of the configuration channel C1 is located at the front end of the insulating base 11 and is adjacent to the inserting portion V11 of the first power terminal V1. The connecting portion C13 of the configuration channel C1 is located at the rear end of the insulating base 11 and extends laterally from the inserting portion C11 of the configuration channel C1 so as to lie between the connecting portion V13 of the first power terminal V1 and the connecting portion G13 of the first ground terminal G1 and form a configuration pin. In other words, when viewed from behind the connector 1, referring to FIG. 4, the configuration pin (i.e., the connecting portion C13 of the configuration channel C1) is between the ground pin (i.e., the connecting portion G13 of the first ground terminal G1) and the power pin (i.e., the connecting portion V13 of the first power terminal V1). Thus, when the connector 1 is in a first application mode as shown in FIG. 4 (e.g., to be used in a "USB Type-C to USB Type-A" transmission cable), the manufacturer can easily connect the two ends of a resistor R to the configuration pin (i.e., the connecting portion C13 of the configuration channel C1) and the power pin (i.e., the connecting portion V13 of the first power terminal V1) respectively; and when the connector 1 is in a second application mode as shown in FIG. 5 (e.g., to be used in a "USB Type-C to Micro-B" transmission cable), the manufacturer can instead connect the two ends of the resistor R to the configuration pin (i.e., the connecting portion C13 of the configuration channel C1) and the ground pin (i.e., the connecting portion G13 of the first ground terminal G1) respectively. That is to say, the manufacturer only has to manufacture the connector 1 of the present invention, and the resistor R can be mounted at a later time according to practical needs, which adds greatly to the convenience of production and stock control. Furthermore, since the resistor R can be connected between the corresponding pins without additional leads, short-circuiting is effectively prevented.

Referring back to FIG. 2 and FIG. 3, the signal transmission terminals D1, D2 extend through the corresponding through holes 110 in the insulating base 11 respectively. The inserting portions D11, D21 of the signal transmission terminals D1, D2 are adjacent to each other and are located between the inserting portion C11 of the configuration channel C1 and the inserting portion V21 of the second power terminal V2. The connecting portions D13, D23 of the signal transmission terminals D1, D2 are located at the rear end of the insulating base 11. In this embodiment, for example, the connecting portion D13 of the first signal transmission terminal D1 is located between the connecting portion V13 of the first power terminal V1 and the connecting portion V23 of the second power terminal V2, and the connecting portion D23 of the second signal transmission terminal D2 extends laterally from the inserting portion D21 of the second signal transmission terminal D2 so as to lie between the connecting portion V23 of the second power terminal V2 and the connecting portion G23 of the second ground terminal G2. Please note that the signal transmission terminals D1, D2 in FIG. 2 and FIG. 3 are the D+ and D− differential signal terminals defined in the USB specification, and that in another embodiment of the present invention, the connecting portion D23 of the second signal transmission terminal D2 may, depending on production or use requirements, be located between the connecting portion D13 of the first signal transmission terminal D1 and the connecting portion V23 of the second power terminal V2 while the connecting portion D13 of the first signal transmission terminal D1 remains between the connecting portion V13 of the first power terminal V1 and the connecting portion V23 of the second power terminal V2.

As shown in FIG. 2 and FIG. 3, the housing 13 is provided therein with a receiving space 130, and both a front section of the insulating base 11 and the inserting portions G11, G21, V11, V21, C11, D11, D21 of the terminals/configuration channel G1, G2, V1, V2, C1, D1, D2 extend into and are received in the receiving space 130. It is understood that the configuration of the housing 13 is not limited to that shown in FIG. 2 and may be adjusted to meet production requirements. To prevent the connector 1 from getting loose after being connected to a transmission port of an electronic device, the connector 1 further includes two grip portions 15, and the insulating base 11 is further formed with two gripping holes 115. The gripping holes 115, each opening at both the front and rear ends of the insulating base 11, flank the through holes 110. Each grip portion 15 extends through the corresponding gripping hole 115 in the insulating base 11. The front ends of the grip portions 15 are located at the front end of the insulating base 11 and are received in the housing 13. The rear ends of the grip portions 15 are located at the rear end of the insulating base 11. When the connector 1 is connected to a transmission port, the grip portions 15 grip the corresponding elements of the transmission port respectively to keep the connector 1 securely connected to the transmission port.

Moreover, in order for the connecting portions G13, G23, V13, V23, C13, D13, and D23 of the terminals/configuration channel G1, G2, V1, V2, C1, D1, D2 to have a greater soldering area, thereby facilitating the fixation of the resistor R or other electric elements or circuits to the connecting portions G13, G23, V13, V23, C13, D13, D23, the connector 1 is further provided with auxiliary plates, as described below with reference to another embodiment of the present invention, using only the first ground terminal G1 as an example. Referring to FIG. 2 and FIG. 3, the connecting portion G13 of the first ground terminal G1 is provided with an auxiliary plate G15. The auxiliary plate G15 extends, and is bent, from the top side of the connecting portion G13 and is perpendicular to the connecting portion G13. In another embodiment of the present invention, however, the auxiliary plate G15 may extend, and be bent, from the bottom side of the connecting portion G13 instead. By the same token, the connecting portions G23, V13, V23, C13, D13, D23 of the terminals/configuration channel G2, V1, V2, C1, D1, D2 may be provided with auxiliary plates G25, V15, V25, C15, D15, D25 respectively.

It should be pointed out that, while FIG. 2 and FIG. 3 show two ground terminals G1, G2 and two power terminals V1, V2, it is feasible for another embodiment of the present invention to have only one ground terminal (e.g., the first ground terminal G1) and only one power terminal (e.g., the first power terminal V1) in order to meet product requirements. Hence, as long as a connector is connectable with a transmission port complying with the USB Type-C specification and has a configuration pin between a ground pin and a power pin, this connector falls within the scope of patent protection sought by the applicant.

While the invention herein disclosed has been described by means of specific embodiments, numerous modifications and variations could be made thereto by those skilled in the art without departing from the scope of the invention set forth in the claims

What is claimed is:

1. A connector with a configuration pin between a ground pin and a power pin, wherein the connector is configured to connect with a transmission port complying with the Universal Serial Bus (USB) Type-C specification, the connector comprising:

an insulating base formed with a plurality of through holes, wherein each of the through holes opens at a front end and a rear end of the insulating base;

a first ground terminal extending through a corresponding one of the through holes in the insulating base, wherein the first ground terminal has an inserting portion at an outermost lateral position of the front end of the insulating base and further has a connecting portion at the rear end of the insulating base and forming the ground pin;

a first power terminal extending through a corresponding one of the through holes in the insulating base, wherein the first power terminal has an inserting portion at the front end of the insulating base and adjacent to the inserting portion of the first ground terminal and further has a connecting portion at the rear end of the insulating base and forming the power pin;

at least one configuration channel extending through a corresponding one of the through holes in the insulating base, wherein the configuration channel has an inserting portion at the front end of the insulating base and adjacent to the inserting portion of the first power terminal and further has a connecting portion at the rear end of the insulating base and extending laterally from the inserting portion of the configuration channel so as to lie between the connecting portion of the first power terminal and the connecting portion of the first ground terminal and forming the configuration pin;

a first signal transmission terminal and a second signal transmission terminal, wherein the signal transmission terminals extend through corresponding ones of the through holes in the insulating base respectively and each have an inserting portion and a connecting portion, the inserting portion of the first signal transmission terminal is between the inserting portion of the configuration channel and the inserting portion of the second signal transmission terminal, and the connecting portions of the signal transmission terminals are at the rear end of the insulating base; and a housing provided therein with a receiving space, wherein a front section of the insulating base and the inserting portions of the terminals and of the configuration channel extend into and are received in the receiving space.

2. The connector of claim 1, wherein the connector is in a first application mode when the connecting portion of the configuration channel and the connecting portion of the first power terminal are connected to two ends of a resistor respectively.

3. The connector of claim 1, wherein the connector is in a second application mode when the connecting portion of the configuration channel and the connecting portion of the first ground terminal are connected to two ends of a resistor respectively.

4. The connector of claim 1, further comprising:

a second power terminal extending through a corresponding one of the through holes in the insulating base, wherein the second power terminal has an inserting portion at the front end of the insulating base and adjacent to the inserting portion of the second signal transmission terminal and further has a connecting portion at the rear end of the insulating base; and a second ground terminal extending through a corresponding one of the through holes in the insulating base, wherein the second ground terminal has an inserting portion at the front end of the insulating base and adjacent to the inserting portion of the second power terminal and further has a connecting portion at the rear end of the insulating base.

5. The connector of claim 2, further comprising:

a second power terminal extending through a corresponding one of the through holes in the insulating base, wherein the second power terminal has an inserting portion at the front end of the insulating base and adjacent to the inserting portion of the second signal transmission terminal and further has a connecting portion at the rear end of the insulating base; and a second ground terminal extending through a corresponding one of the through holes in the insulating base, wherein the second ground terminal has an inserting portion at the front end of the insulating base and adjacent to the inserting portion of the second power terminal and further has a connecting portion at the rear end of the insulating base.

6. The connector of claim 3, further comprising:

a second power terminal extending through a corresponding one of the through holes in the insulating base, wherein the second power terminal has an inserting portion at the front end of the insulating base and adjacent to the inserting portion of the second signal transmission terminal and further has a connecting portion at the rear end of the insulating base; and a second ground terminal extending through a corresponding one of the through holes in the insulating base, wherein the second ground terminal has an inserting portion at the front end of the insulating base and adjacent to the inserting portion of the second power terminal and further has a connecting portion at the rear end of the insulating base.

7. The connector of claim 4, wherein the connecting portions of the terminals and of the configuration channel are each provided with an auxiliary plate, and each of the auxiliary plates extends, and is bent, from a top side or a bottom side of a corresponding one of the connecting portions and is perpendicular to the corresponding one of the connecting portions.

8. The connector of claim 5, wherein the connecting portions of the terminals and of the configuration channel are each provided with an auxiliary plate, and each of the auxiliary plates extends, and is bent, from a top side or a bottom side of a corresponding one of the connecting portions and is perpendicular to the corresponding one of the connecting portions.

9. The connector of claim 6, wherein the connecting portions of the terminals and of the configuration channel are each provided with an auxiliary plate, and each of the auxiliary plates extends, and is bent, from a top side or a bottom side of a corresponding one of the connecting portions and is perpendicular to the corresponding one of the connecting portions.

10. The connector of claim 7, wherein the connecting portion of the first signal transmission terminal is between the connecting portion of the first power terminal and the connecting portion of the second power terminal.

11. The connector of claim 8, wherein the connecting portion of the first signal transmission terminal is between the connecting portion of the first power terminal and the connecting portion of the second power terminal.

12. The connector of claim 9, wherein the connecting portion of the first signal transmission terminal is between the connecting portion of the first power terminal and the connecting portion of the second power terminal.

13. The connector of claim 10, wherein the connecting portion of the second signal transmission terminal extends laterally from the inserting portion of the second signal transmission terminal so as to lie between the connecting portion of the second power terminal and the connecting portion of the second ground terminal.

14. The connector of claim 11, wherein the connecting portion of the second signal transmission terminal extends laterally from the inserting portion of the second signal transmission terminal so as to lie between the connecting portion of the second power terminal and the connecting portion of the second ground terminal.

15. The connector of claim 12, wherein the connecting portion of the second signal transmission terminal extends laterally from the inserting portion of the second signal transmission terminal so as to lie between the connecting portion of the second power terminal and the connecting portion of the second ground terminal.

16. The connector of claim 10, wherein the connecting portion of the second signal transmission terminal is between the connecting portion of the first signal transmission terminal and the connecting portion of the second power terminal.

17. The connector of claim 11, wherein the connecting portion of the second signal transmission terminal is between the connecting portion of the first signal transmission terminal and the connecting portion of the second power terminal.

18. The connector of claim 12, wherein the connecting portion of the second signal transmission terminal is between the connecting portion of the first signal transmission terminal and the connecting portion of the second power terminal.

* * * * *